United States Patent [19]

Fleming et al.

[11] Patent Number: 4,660,887

[45] Date of Patent: Apr. 28, 1987

[54] ERGONOMIC SUPPORT

[75] Inventors: Philip S. Fleming, Montclair, N.J.; Richard M. Neagle, New York, N.Y.

[73] Assignee: The Shaw-Walker Company, Muskegeon, Mich.

[21] Appl. No.: 774,900

[22] Filed: Sep. 11, 1985

[51] Int. Cl.[4] ..... A47C 1/12

[52] U.S. Cl. ..... 297/445; 297/452; 297/458; 297/460

[58] Field of Search ..... 297/457, 418, 458, 16, 297/42, 452, 460, 445, 440

[56] References Cited

U.S. PATENT DOCUMENTS

| | | | |
|---|---|---|---|
| 2,649,146 | 8/1953 | Sanford et al. | 297/418 |
| 3,165,356 | 1/1965 | Grier et al. | 297/460 X |
| 4,108,490 | 8/1978 | Marin | 297/42 |
| 4,202,581 | 5/1980 | Fleschman | 297/440 |
| 4,368,917 | 1/1983 | Urai | 297/452 |
| 4,390,209 | 6/1983 | Fleishman | 297/16 |
| 4,418,958 | 12/1983 | Watkin | 297/458 |
| 4,502,731 | 3/1985 | Snider | 297/452 |
| 4,533,174 | 8/1985 | Fleishman | 297/457 |
| 4,572,578 | 2/1986 | Perkins | 297/460 |

*Primary Examiner*—James T. McCall

*Attorney, Agent, or Firm*—Lerner, David, Littenberg, Krumholz & Mentlik

[57] ABSTRACT

An ergonomic support in the nature of chairs, sofas and the like, includes flexible and resilient posterior and lumbar supporting portions having non-planar, contoured shaped surfaces which comfortably conform to the body. The supporting portion is shaped to form a plurality of cantilevers which automatically adjust and conform to body movement without mechanical parts, as opposed to adjusting the body to conform to the supporting portion.

65 Claims, 18 Drawing Figures

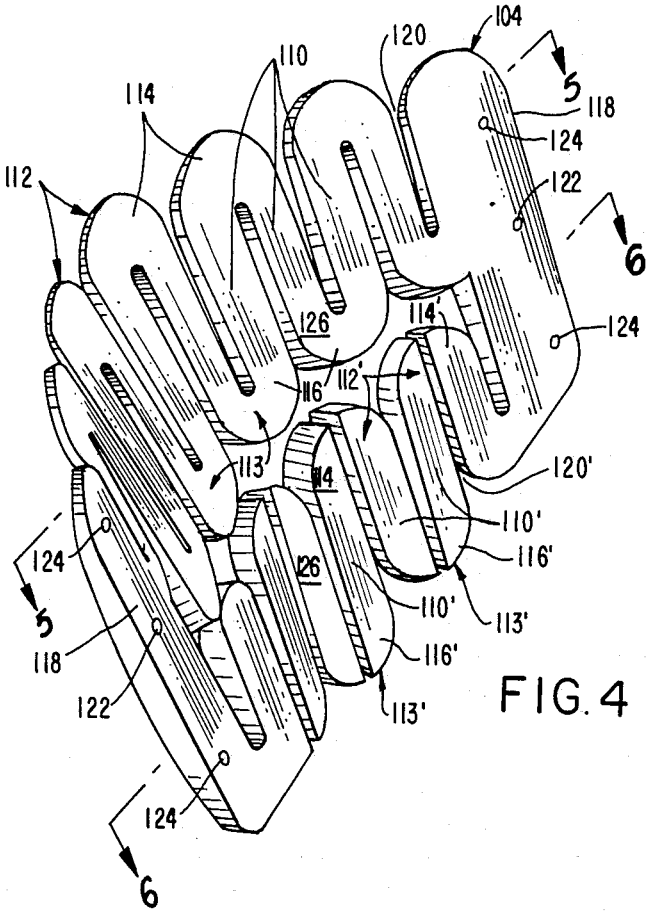
FIG. 4
FIG. 5
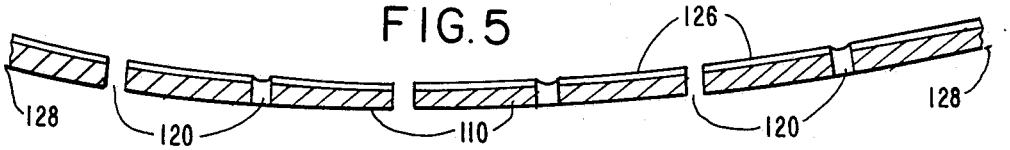
FIG. 6
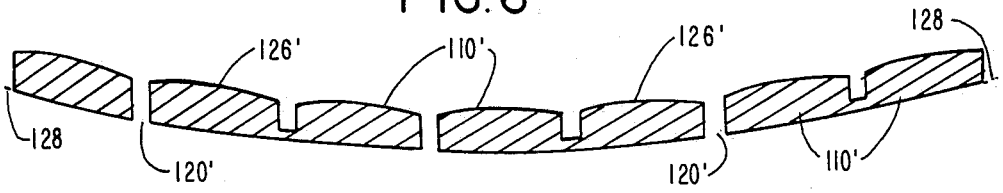

ERGONOMIC SUPPORT

BACKGROUND OF THE INVENTION

The present invention relates in general to an ergonomic support in the nature of chairs, sofas and the like, and more particularly, to such an ergonomic support having posterior and/or lumbar supporting portions which automatically conform to body movement without mechanical parts, as opposed to adjusting the body to comfortably conform to the posterior and lumbar supporting portions. Still more particularly, the posterior and/or lumbar supporting portions include non-planar contoured supporting surfaces shaped as compound curves, i.e., three-dimensional, thereby providing an effective ergonomic support for different body positions.

The art of designing body supports, in the nature of chairs and sofas having posterior and lumbar supporting portions, has thus far imperfectly take into consideration man's need to have a comfortable and flexible support which continuously conforms to different body positions. For example, chairs and sofas are known to be constructed from posterior and lumbar supporting assemblies consisting generally of a frame having a plurality of springs, a cushion or pad which rests on the springs, and an upholstery cover. These assemblies, although flexible due to their spring construction, assume a predetermined fixed shape which requires that man adjust his body position relative to these assemblies for maximum comfort. As chairs and sofas are a vital part of man's work and leisure environment, there is the need of providing a body support which is constructed to continuously conform to man's different body positions to provide maximum comfort.

Various structures have been proposed for posterior and lumbar supporting assemblies which are designed to possess increased flexiblity while providing body support. Such structures are known, for example, from U.S. Pat. Nos. 270,093, 2,804,129, 2,833,339, 3,399,883, 4,158,899 and 4,502,731. However, each of these structures merely provide an assembly having a plurality of openings to increase flexibility, rather than being designed in a manner which permits their continuous adjustment in conforming to different body positions to maximize comfort.

Other known structures have been designed as portable and collapsible chairs which include lumbar and posterior supporting portions constructed in the nature of serpentine-shaped members. Such structures are known, for example, from U.S. Pat. Nos. 4,533,174, 4,390,204 and 4,202,581. However, being portable and collapsible, these chairs are generally unsuitable both in construction and functionality in providing a comfortable support which can continuously conform to different body positions. In addition, these chairs are designed such that the serpentine-shaped members of the lumbar and posterior supporting portions are arranged to provide either a flat or non-contoured, planar supporting surface, i.e., simple curve. As a result, the serpentine-shaped members cannot sufficiently conform to the lumbar and posterior regions of a person when shifted to assume different body positions so as to provide an effective ergonomic support.

It can therefore be appreciated that there is an unsolved need for an ergonomic support in the nature of chairs, sofas and the like which, in addition to including flexible posterior and/or lumbar supporting portions having contoured supporting members, is constructed to continuously conform to different body positions to provide maximum comfort.

SUMMARY OF THE INVENTION

It is broadly an object of the present invention to provide an ergonomic support, and more particularly, to provide posterior and lumbar supporting assemblies for a chair or sofa which avoids or overcomes one or more of the foregoing disadvantages resulting from the use of the above-mentioned prior art structures, and which fulfills the specific requirements of such an ergonomic support as set forth herein. Specifically, it is within the contemplation of one aspect of the present invention to provide an ergonomic support which includes a plurality of resilient support members each independently and cooperatively performing a support function.

Another object of the present invention is to provide an ergonomic support which adjusts to body movement without mechanical components.

Another object of the present invention is to provide an ergonomic support which is inexpensive to manufacture from a variety of materials, including injection molded plastics.

Another object of the present invention is to provide an ergonomic support which includes a posterior and/or lumbar supporting shaped assembly each of unitary construction.

Another object of the present invention is to provide an ergonomic support which employs patterned resilient cantilevers to achieve controlled support.

Another object of the present invention is to provide an ergonomic support which can be blow molded or injection molded to provide an integral posterior and lumbar supporting portion.

Another object of the present invention is to provide an ergonomic support whose flexibility and resiliency can be readily varied by design changes.

Another object of the present invention is to provide an ergonomic support having support members arranged to provide contoured, non-planar supporting surfaces for the lumbar and/or posterior regions of the body.

Another object of the present invention is to provide an ergonomic support having support members arranged to provide lumbar and/or posterior supporting surfaces formed of compound curves.

In accordance with one embodiment of the present invention, there is provided an ergonomic support constructed of a posterior supporting portion, and a lumbar supporting portion, the lumbar supporting portion including a plurality of first support members joined together to individually and cooperatively provide flexible support for the lumbar region of a person, each of the support member having a portion separated from an adjacent support member by an elongated opening, a ratio of the width of the opening to the width of an adjacent the support member being in the range of about 1:4 to 1:11, whereby the support members conform to the lumbar region of a person for different body positions.

In accordance with another embodiment of the present invention, there is provided an ergonomic support constructed of a posterior supporting portion, and a lumbar supporting portion, the lumbar supporting portion including a plurality of first support members joined together to individually and cooperatively provide flexible support for the lumbar region of a person, the support members each having a rear surface and a lumbar supporting front surface, the front surface having portions extending outwardly varying distances from a common reference plane, whereby the support members conform to the lumbar region of a person for different body positions.

In accordance with another embodiment of the present invention, there is provided an ergonomic support constructed of a posterior supporting portion, a lumbar supporting portion, at least one of the supporting portions comprising a first shell portion having an inner member and an outer member, the inner member forming the supporting portion, and a plurality of first support members formed from a portion of the inner member of the first shell portion, the support members joined together to individually and cooperatively provide flexible support for a supported region of a person, whereby the support members conform to the supported region for different body positions.

In accordance with another embodiment of the present invention, there is provided an ergonomic support constructed of a posterior supporting portion, a lumbar supporting portion, and attaching means for attaching the lumbar supporting portion adjacent to the posterior supporting portion, the lumbar supporting portion including a plurality of first support members jointed together to individually and cooperatively provide flexible support for the lumber region of a person, the lumbar supporting portion pivotally attached at opposite ends thereof to the attaching means, whereby the support members conform to the lumbar region of a person for different body positions.

In accordance with another embodiment of the present invention, there is provided an ergonomic support comprising a lumbar supporting portion and a posterior supporting portion, at least one of the portions including a first non-planar member having a contoured body supporting surface, and a plurality of first support members formed from a portion of the non-planar member, the support members joined together to individually and cooperatively provide flexible support for a supported region of a person, whereby the support member conforms to the supported region for different body positions.

BRIEF DESCRIPTION OF THE DRAWINGS

The above description, as well as further objects, features and advantages of the present invention, will be more fully understood by reference to the following detailed description of a presently preferred, but nonetheless illustrative, ergonomic support in accordance with the present invention when taken in conjunction with the accompanying drawings, wherein:

FIG. 4 is a perspective view of the preferred embodiment of the lumbar supporting portion and having a lumbar supporting front surface constructed as a non-planar, compound curved surface;

FIG. 5 is a cross-sectional view taken along Line 5—5 of FIG. 4, showing the lumbar supporting front surface having portions thereof extending outwardly varying distances from a common reference plane;

FIG. 6 is a cross-sectional view taken along Line 6—6 of FIG. 4, showing the lumbar supporting front surface having portions thereof extending outwardly varying distances from a common reference plane;

DETAILED DESCRIPTION

Figure 1:
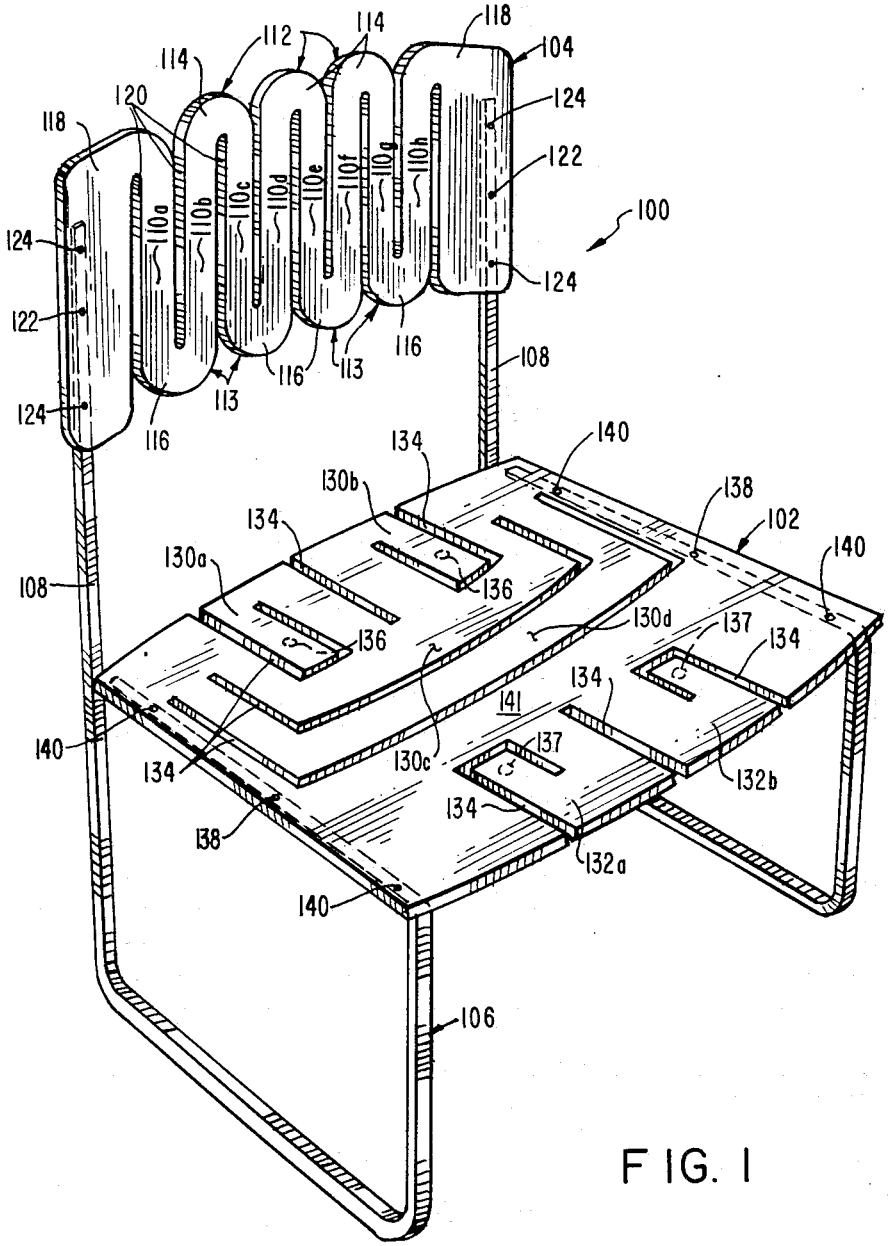
FIG. 1 is a perspective view of one embodiment of an ergonomic support constructed in the nature of a chair including a posterior supporting portion and a lumbar supporting portion each having resilient support members independently and cooperatively performing support functions.

Referring now to the drawings, wherein like reference numerals represent like elements, there is shown in FIG. 1 a perspective view of an ergonomic chair constructed in accordance with the present invention and designated generally by reference numeral 100. Although the invention will be described with reference to the chair 100, it is to be understood that the principles of the present invention, as described in the foregoing description, are applicable to other forms of ergonomic seating supports, for example, benches, stools, rockers, recliners, sofas, couches, lounges, and the like. The chair 100 is generally constructed of a posterior supporting portion 102, i.e., chair bottom, a lumbar supporting portion 104, i.e., chair back, and a supporting frame 106 having upstanding spaced-apart side frame members 108. The posterior supporting portion 102 and lumbar supporting portion 104 may be constructed from a variety of material, for example, wood, metal, aluminum, plastic, and the like.

The lumbar supporting portion 104 is constructed from a plurality of support members **110*a*–110*h* arranged adjacent one another and joined together to individually and cooperatively provide flexible support to the lumbar region of a person. The support members 110*a*–110*h* are joined together to provide a plurality of upwardly extending cantilevers 112 and a plurality of downwardly extending cantilevers 113 joined together in serpentine or sinusoidal shape. Each upwardly extending cantilever 112 is formed, for example, from a pair of adjacent support members 110***d*, 110*e* joined together at one common end 114 and supported at their other common end 116 by adjacent support members 110*c*, 110*f*. Each downwardly extending cantilever 113 is constructed in a similar manner. As a result of this sinusoidal shape, each upwardly extending cantilever 112 contains a common support member 110*a*–110*h* with an adjacent downwardly extending cantilever 113. The single row of support members 110*a*–110*h* is supported at opposite ends thereof by connection to a pair of end joining members 118.

The cantilevers 112, 113 are formed by cutting, in the case of wood or metal, and molding, in the case of plastic, a plurality of parallel spaced-apart elongated openings 120 to define the individual support members 110*a*–110*h*. The openings 120 provide the lumbar supporting portion 104 with the resiliency and flexibility necessary to allow each of the support members 110*a*–110*h* to function in a manner to independently and cooperatively support the lumbar portion of a person, notwithstanding the rigid properties of their material of construction. The openings 120 are dimensioned such that the ratio of the width of the openings to the width of an adjacent support member 110*a*–110*h* is in the range of about 1:4 to 1:11. Preferably, such ratio is in the range of about 1:4 to 1:5.

The lumbar supporting portion 104 is pivotally attached about pivot points 122, located on the end joining members 118, to the side frame members 108. The foregoing construction of the lumbar supporting portion 104 and its pivotal attachment to the side frame members 108 allows the support members 110*a*–110*h*, and thus formed cantilevers 112, 113, to individually and cooperatively provide flexible support for the lumbar region of a person. The lumbar supporting portion 104 becomes totally flexible, allowing twisting and tilting of the individual support members 110*a*–110*h*, and thus formed cantilevers 112, 113, in a manner which continuously adjusts and conforms to the lumbar region of a person. Where less flexibility of the lumbar supporting portion 104 is desired, it may be attached to the side frame members 108 by means of two spaced-apart connecting points 124 located on the end joining members 118. The location of the pivot point 122, with respect to the longitudinal and transvers axes of the end joining members 118, may be varied to effect the degree and nature of twisting of the lumbar supporting portion 104. In addition, individual support members 110*a*–110*h* may be constructed of different cross-sectional areas, i.e., thicknesses, to provide varying degrees of flexibility and resiliency to the lumbar supporting portion 104. Still further, the support members 110*a*–110*h* may be laminated with composite materials having different resiliency and flexibility characteristics in order to profile the flexing properties of the lumbar supporting portion 104.

Figure 2:
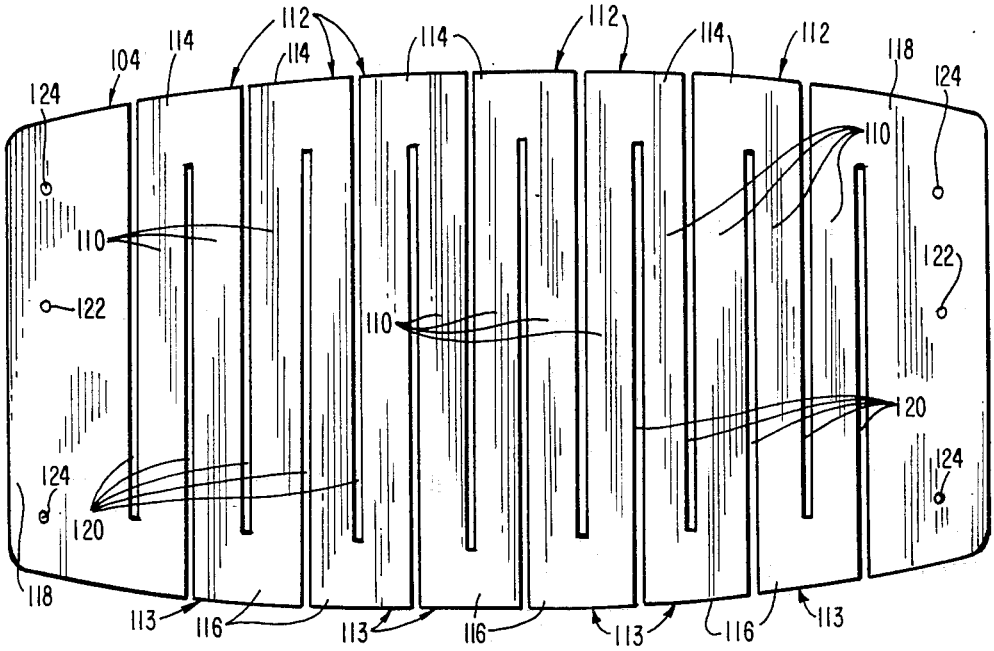
FIG. 2 is a front elevational view of another embodiment of the lumbar supporting portion and having a sinusoidal shape.
Figure 3:
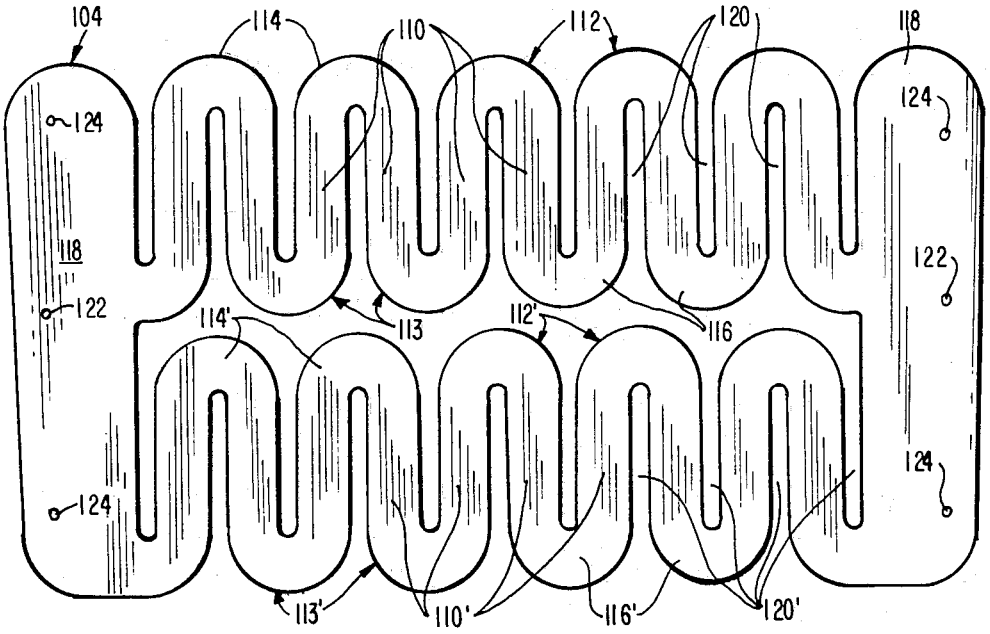
FIG. 3 is another embodiment of the lumbar supporting portion and having two rows of support members, each of sinusoidal shape.

Referring now to FIGS. 2 and 3, there is shown two additional embodiments of the lumbar supporting portion 104 constructed in accordance with the present invention. As shown in FIG. 2, the support members 110, and thus formed cantilevers 112, 113, have a generally rectangular shape, as opposed to the rounded shape in accordance with the embodiment disclosed in FIG. 1. In addition, the ratio of the width of the elongated opening 120 to the width of an adjacent support member 110 is about 1:11, whereas the ratio in the embodiment of FIG. 1 is about 1:4. This construction results in the lumbar supporting portion 104, as disclosed in FIG. 2, being less flexible than the lumbar supporting portion constructed in accordance with the embodiment disclosed in FIG. 1.

As shown in FIG. 3, the lumbar supporting portion 104 is provided with an upper row of support members 110 and a lower row of support members 110'. The upper row of support members 110, and thus formed cantilevers 112, 113, individually and cooperatively provide flexible support for the upper lumbar region. On the other hand, the lower row of support members 110', and thus formed cantilevers 112', 113', individually and cooperatively provide flexible support for the lower lumbar region. Although not shown, the cross-sectional area and/or material of construction of the individual support members 110, 110' can be varied to provide the lumbar supporting portion 104 with varying degrees of flexibility and resiliency as desired.

Turning now to FIGS. 4–6, the preferred embodiment of the lumbar supporting portion 104 in accordance with the present invention will now be described. The lumbar supporting portion 104 is constructed to include an upper row of support members 110 and a lower row of support members 110' in accordance with the embodiment disclosed in FIG. 3. As more clearly shown in cross-section in FIGS. 5 and 6, the outer lumbar supporting surfaces 126, 126' of the upper row of support members 110 and lower row of support members 110' are formed as a compound curved surface. In other words, the outer lumbar supporting surfaces 126, 126' are three-dimensional, by being non-planar, contoured front surfaces, thereby providing an effective ergonomic support. As shown, the outer lumbar supporting surfaces 126, 126' have various portions thereof extending outwardly varying distances from a common reference plane 128. For example, the outer lumbar supporting surface 126 tapers outwardly from end 114 towards end 116 of the cantilevers 112, 113. This results from the support members 110 having a generally wedge-shaped cross-section. On the other hand, the outer lumbar supporting surface 126' of the support members 110' is curved outwardly between the ends 114', 116' of the cantilevers 112', 113'. This results in the support members 110' having a concave rectangular cross-section. Consequently, the lower row of support members 110', and thus formed cantilevers 112', 113' being slightly bowed, provide selective increased support as is required for the lower lumbar region. In addition, the cross-sectional thickness of each support member 110, 110' can be varied to provide a profiled lumbar supporting portion 104 of varying resiliency and flexibility.

Turning once again to FIG. 1, the posterior supporting portion 102 includes a rear portion provided with a plurality of support members 130*a*–130*d* and a front portion having a plurality of flexible support members 132*a*, 132*b* provided by a patterned arrangement of a plurality of elongated openings 134. The elongated openings 134 include generally U-shaped openings symmetrically arranged about a pair of co-linear straight openings arranged along the rear and forward portions of the posterior supporting portion 102. As a result of the foregoing construction, the support members 130*a*–130*d* individually and cooperatively provide flexible support for the posterior portion of a person.

More particularly, the locations 136 on the support members 130*a*, 130*b*, as indicated in phantom, are so arranged to support the left and right ischial tuberosity of a person. On the other hand, the flexible support members 132*a*, 132*b* are adapted for supporting the upper leg portion of a person when normally seated. The flexible support member 132*a*, 132*b* additionally will support the posterior region of a person when slid forward in the chair 100, for example, left and right ischial tuberosity at locations 137, as indicated in phantom. This provides an ergonomic support even in the forward position when one sits on the front edge of the posterior supporting portion 102 of the chair 100. Like the lumbar supporting portion 104, the posterior portion 102 may include support members 130*a*–130*d* and flexible support members 132*a*, 132*b* of different cross-sectional areas, or laminated with different materials having different flexibility and resiliency characteristics to achieve controlled flexibility and resiliency of the posterior supporting portion. Additionally, the supporting members 130*a*–130*d* and flexible supporting members 132*a*, 132*b* function as resilient cantilevers to achieve controlled support of the posterior portion of a person.

The posterior supporting portion 102 may be secured to the supporting frame 106 by centrally disposed pivot points 138. As such, the posterior supporting portion 102 will function by twisting and flexing about pivot points 138 to provide continuous adjustment and conforming to the posterior region of a person. Where less flexibility is desired, the posterior supporting portion 102 may be secured to the supporting frame 106 at spaced-apart connecting points 140. Thus, it should be understood that the posterior supporting portion 102 is provided with a number of design elements which permit great latitude in flexibilty, resiliency and ability to adjust and conform to the posterior region of a person.

Figure 7:
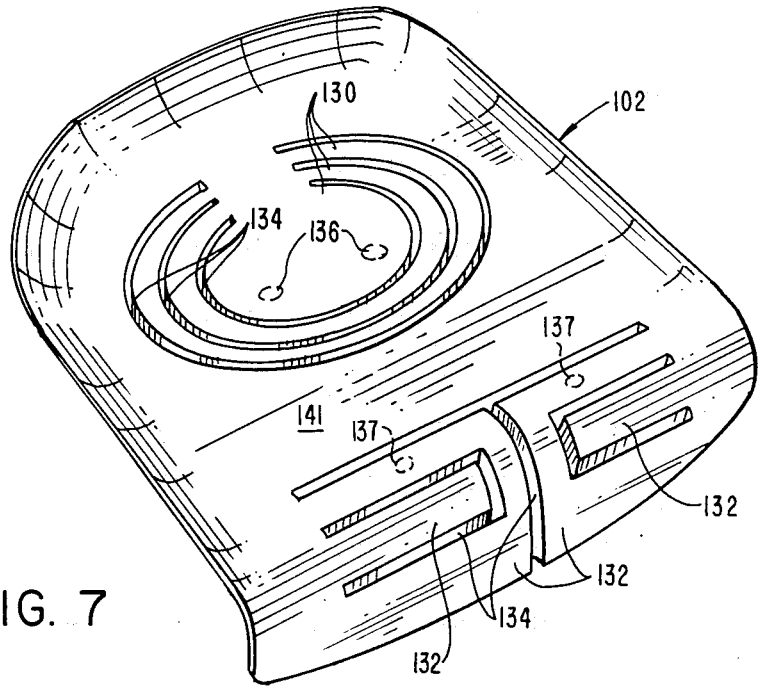
FIGS. 7–12 are perspective views of various preferred embodiments of the posterior supporting portion having support members of different shape, a downwardly curved front edge including flexible support members, and a posterior supporting surface constructed as a non-planar, compound curved surface.
Figure 8:
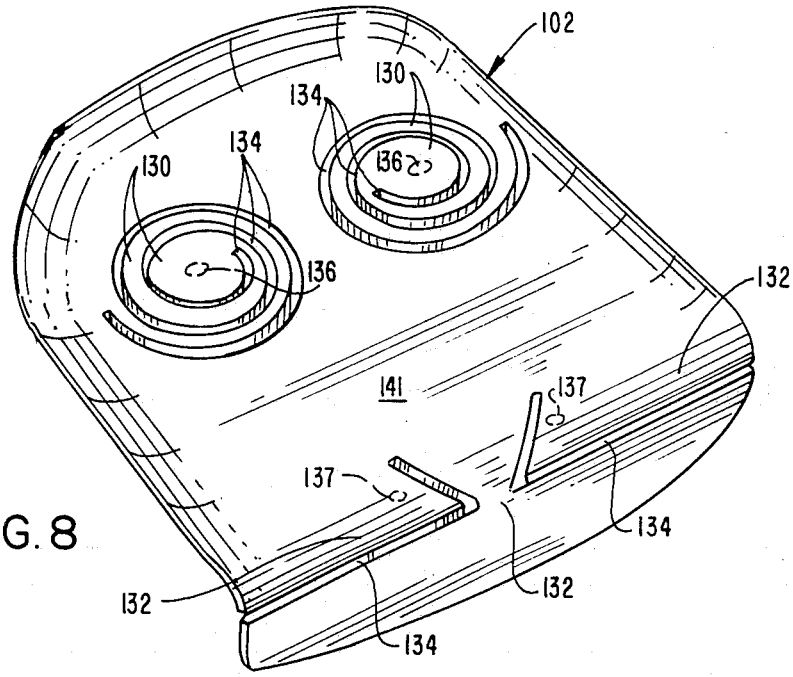
Figure 9:
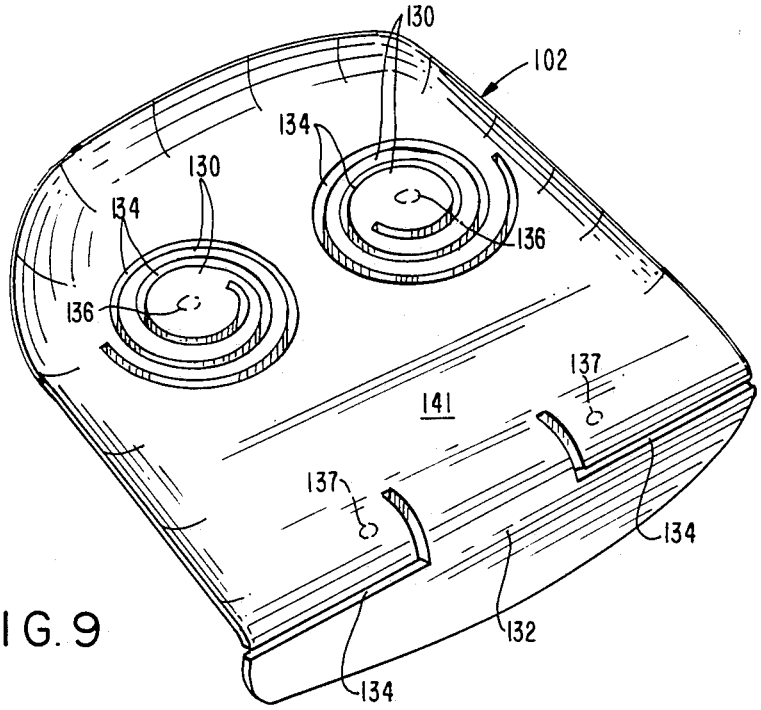
Figure 10:
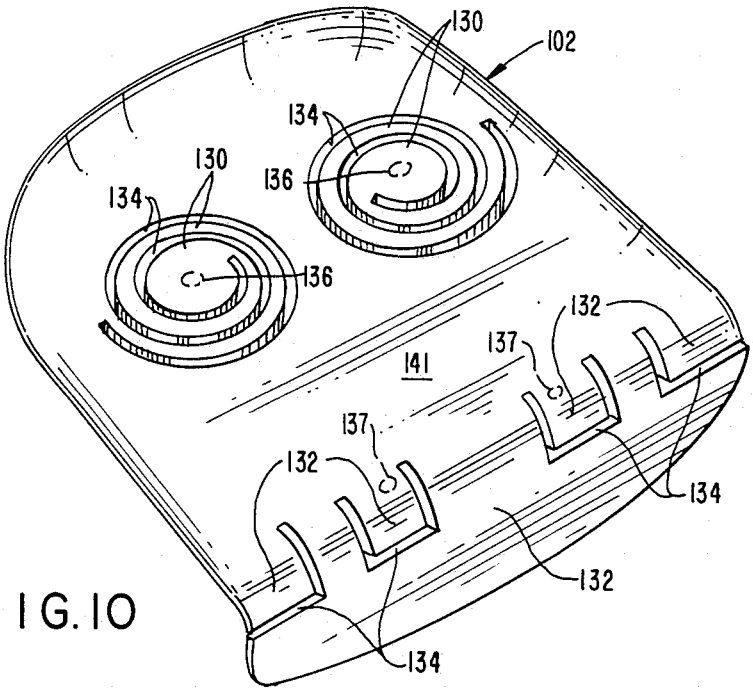
Figure 11:
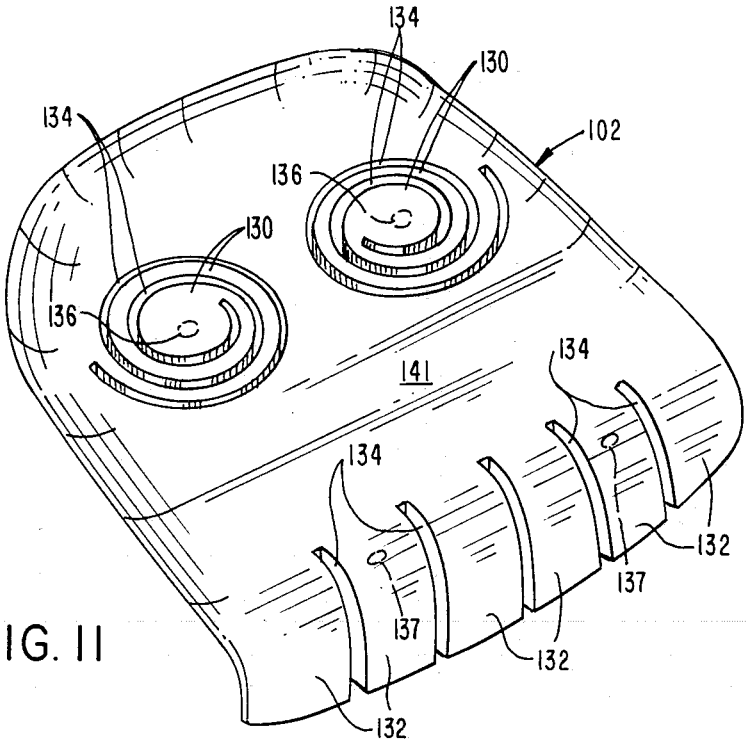
Figure 12:
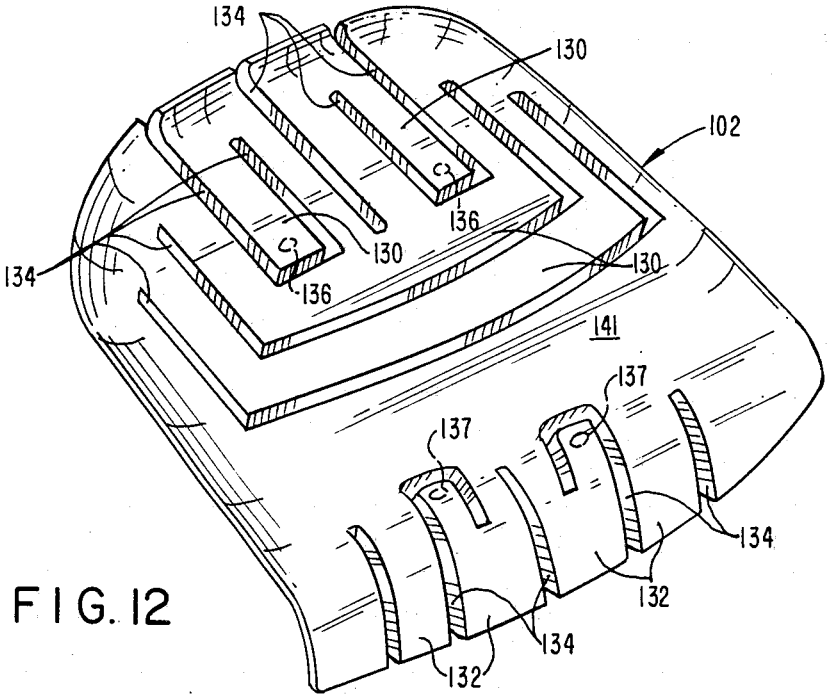

Turning now to FIGS. 7–12, there is disclosed various preferred embodiments of the posterior supporting portion 102 constructed in accordance with the present invention. As shown, the posterior supporting portion 102 is shaped to provide a posterior supporting surface 141 which is contoured, i.e., three-dimensional, by employing non-planar, compound curves. As a result, the supporting surface 141 comfortably conforms to the overall posterior region as one sits while the support members 130 and flexible support members 132 continuously adjust and conform to the posterior region of a person when in different sitting positions. The concentric support members 130, as shown in FIG. 7, are formed between concentric C-shaped elongated openings 134. On the other hand, as shown in FIG. 8, the support members 130 are formed between a pair of adjacent spiral-shaped elongated openings 134. It should therefore be understood that the posterior supporting portion 102 can be constructed to include a variety of shaped support members 130 as a result of providing a patterned elongated opening 134. As further shown in FIGS. 7 and 8, locations 136 for supporting the left and right ischial tuberosities are provided where the posterior supporting portion 102 has its greatest flexibility, i.e., on the central support member 130.

Referring again to FIGS. 7–12, the front portion of each posterior supporting portion 102 is provided with a variety of patterned elongated openings 134 to provide flexible support member 132 of various shapes and sizes. The elongated openings 134 may be straight openings, U-shaped openings, T-shaped openings, V-shaped openings, L-shaped openings and the like, to provide the various patterns illustrated. As is further shown, the front portion of the posterior supporting portion 102 may be curved downwardly in a so-called waterfall effect, which portion includes the flexible support members 132. Preferably, the center axis 142 of curvature for the front portion of the posterior supporting portion 102 extends through the base and leg of the U-shaped and L-shaped elongated openings 134. As in the previous embodiments, the support members 130 and flexible support members 132 can be constructed of different cross-sectional areas, or laminated with different materials having different flexibility and resiliency characteristics, or varying contoured supporting surfaces to achieve controlled flexibility and resiliency of the posterior supporting portion 102. Thus, it should be understood that the posterior supporting portion 102, in accordance with the preferred embodiment, is provided with a number of design elements which permit great latitude in flexibility, resiliency and ability to adjust and conform to the posterior region of a person.

Figure 13:
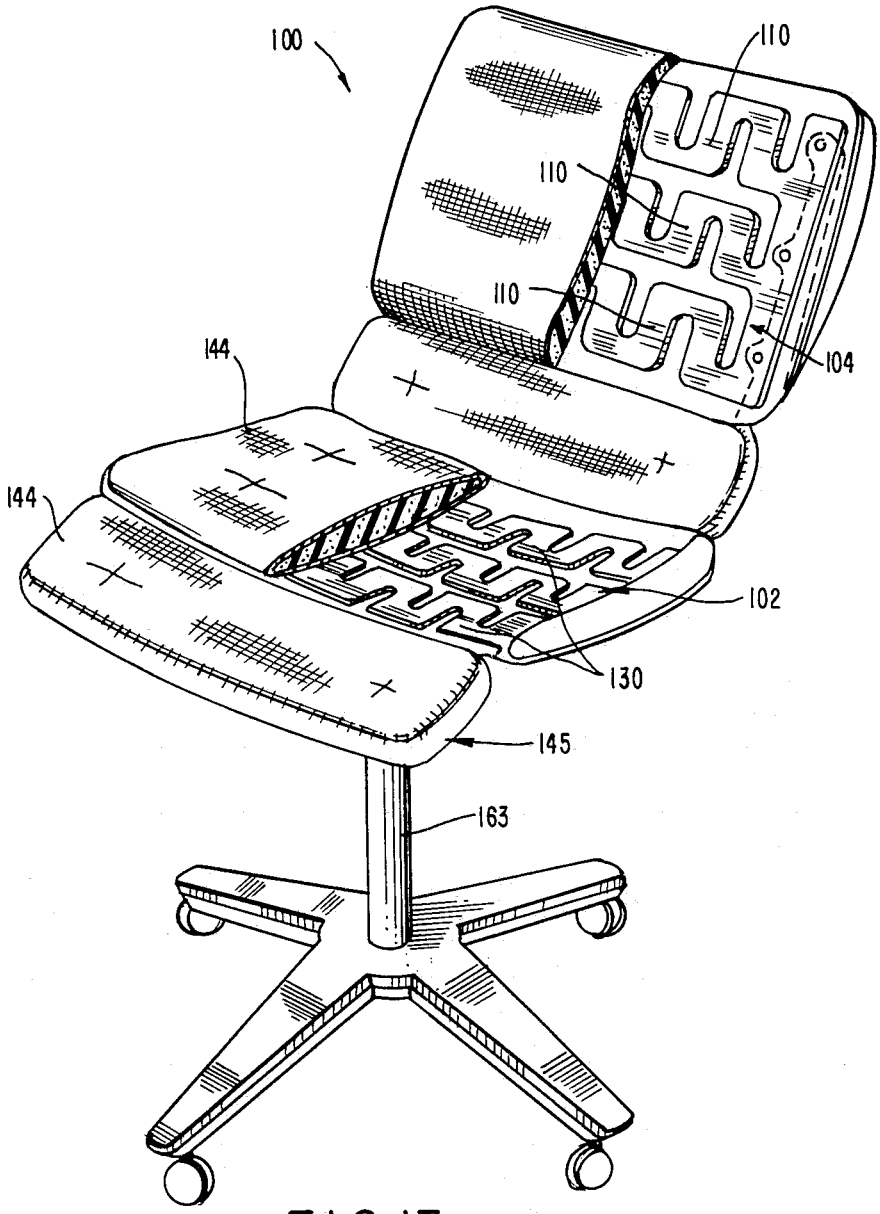
FIGS. 13 and 14 are perspective views of anther embodiment of an ergonomic chair having an upholstered posterior and lumbar supporting portion and a front edge sitting position.
Figure 14:
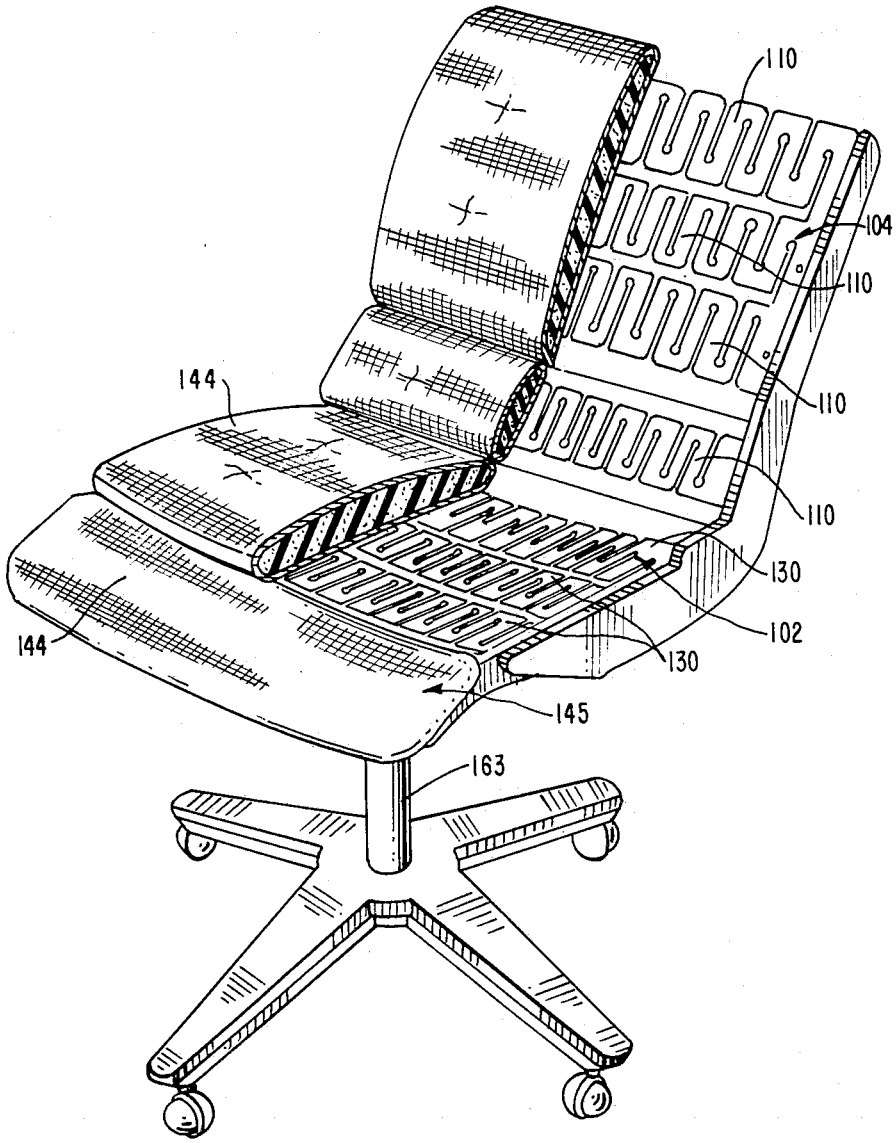

Turning now to FIGS. 13 and 14, there is disclosed another embodiment of the present invention, wherein the chair 100 is provided with an upholstered outer covering 144 hiding from view the posterior supporting portion 102 and lumbar supporting portion 104. In addition, the posterior supporting portion 102 includes a separate upholstered front sitting position support 145 constructed to include flexible support members 132 (not shown) as described with reference to FIGS. 1 and 7–12. The lumbar supporting portion 104 of FIG. 13 is constructed of three rows of support members 110, while being constructed of four rows of support members in the embodiment shown in FIG. 14. Further, the posterior supporting portion 102 is constructed similar to the lumbar supporting portion 104. That is, the support members 130 of the posterior supporting portion 102 are arranged in a serpentine or sinusoidal shape in multiple rows to individually and cooperatively provide flexible support for the posterior region of a person. It should therefore be understood that the principles of the present invention provide for a great variety in latitude and flexibility in the design and construction of the posterior supporting portion 102 and lumbar supporting portion 104.

Figure 15:
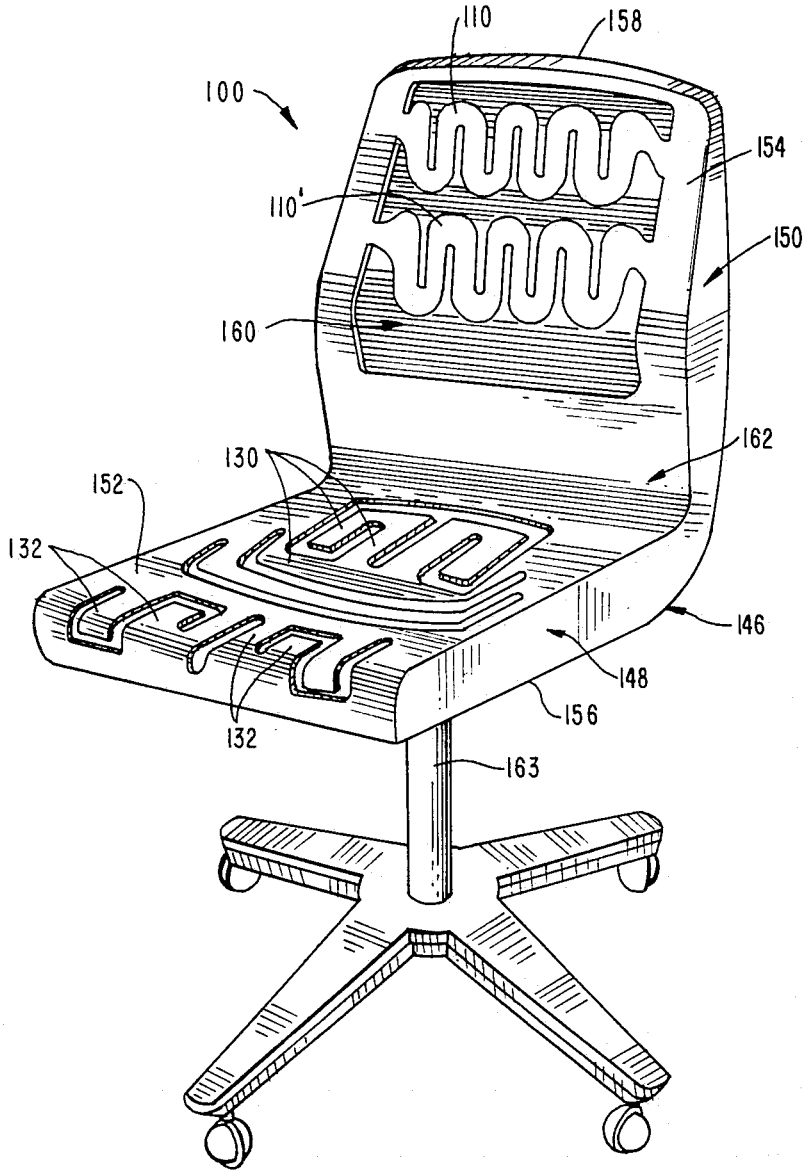
FIG. 15 is a perspective view of another embodiment of an ergonomic chair wherein the posterior and lumbar supporting portions are blow molded as an integral hollow shell.

Turning now to FIG. 15, the chair 100 is constructed of a blow molded shell 146 including a posterior supporting shell portion 148 and a lumbar supporting shell portion 150. The posterior and lumbar supporting shell portions 148, 150 include inner shell members 152, 154 and outer shell members 156, 158, respectively, defining a cavity 160 therebetween. The posterior and lumbar supporting shells 148, 150 are integrally joined by a central connecting shell portion 162. The support members 110 of the lumbar supporting shell portion 150 and the support members 130 and flexible support members 132 of the posterior supporting shell 148 are, respectively, formed in the inner shell members 154, 152 by, for example, laser cutting, molding, hot-knife cutting and the like. The shell 146 may be manufactured from a variety of engineered plastics, for example, polycarbonates and the like.

The support members 110 of the lumbar supporting shell portion 150 and the support members 130 and flexible support members 132 of the posterior supporting shell portion 148 may be constructed to include the various features thus far described with respect to the other embodiments of the present invention, as shown in FIGS. 1–14. In addition, the cavity 160 may be filled with foam blown therein, for example, polyurethane foam, to provide extra support and cushioning. The posterior and lumbar supporting shell portions 148, 150 may be upholstered or may be provided with self-skinning foam cushioning material to hide the support members 110, 130 and flexible support members 132. A tilt mechanism (not shown) for the chair 100 may be hidden within the cavity 160 of the posterior supporting shell 148 for attaching a pedestal base 163 thereto. Further, the chair 100, as in the other embodiments, may be provided with arms (not shown), if desired.

Figure 16:
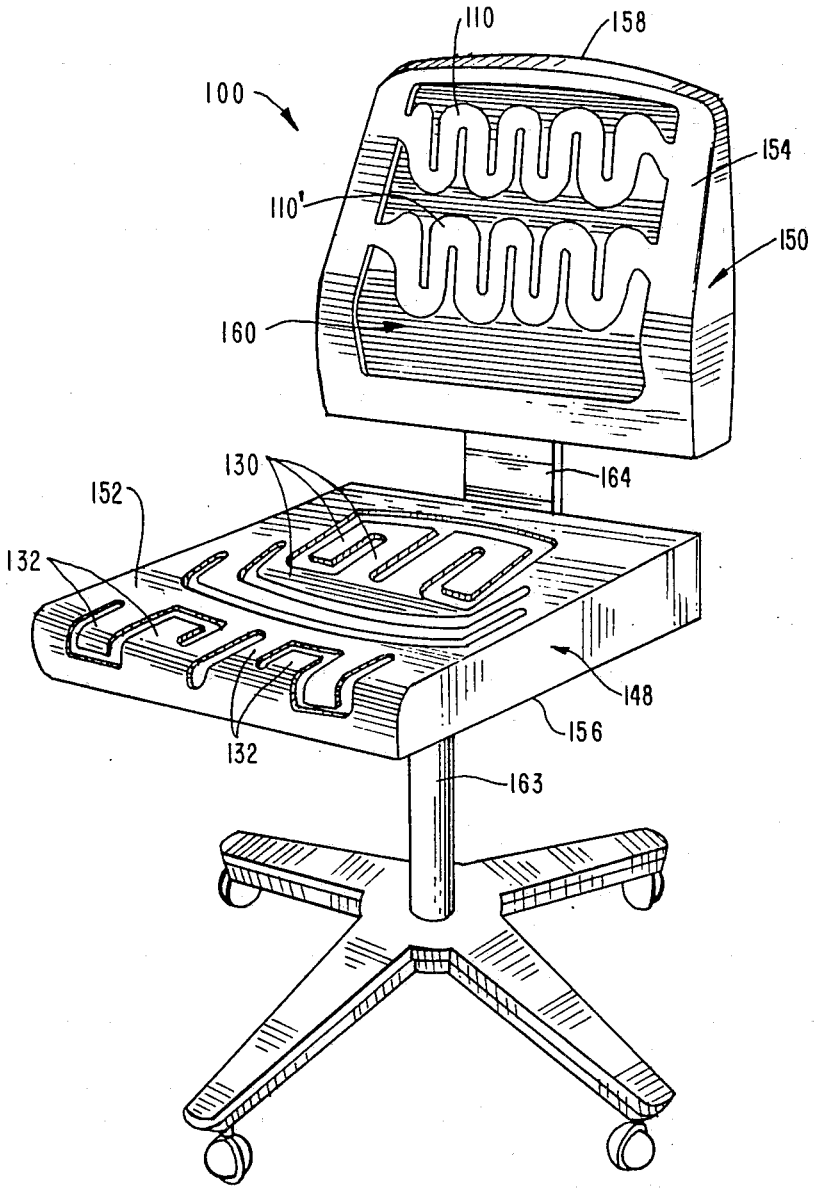
FIG. 16 is a perspective view of another embodiment of an ergonomic chair having the posterior and lumbar supporting portions blow molded into individual hollow shells connected by a J-shaped member.

Turning to FIG. 16, another embodiment of the chair 100 is shown, wherein the posterior supporting shell portion 148 and lumbar supporting shell portion 150 are separately formed and connected together by a J-shaped member 164. The J-shaped member 164 is secured to the outer shell members 156, 158 of the posterior and lumbar supporting shell portions 148, 150. The J-shaped member 164 permits flexing of the lumbar supporting shell portion 150 relative to the posterior supporting shell portion 148. Additionally, the lumbar supporting shell portion 150 can be attached to the posterior supporting shell portion 148 by means of side frame members (not shown) in the manner described with reference to the embodiment illustrated in FIG. 1.

Figure 17:
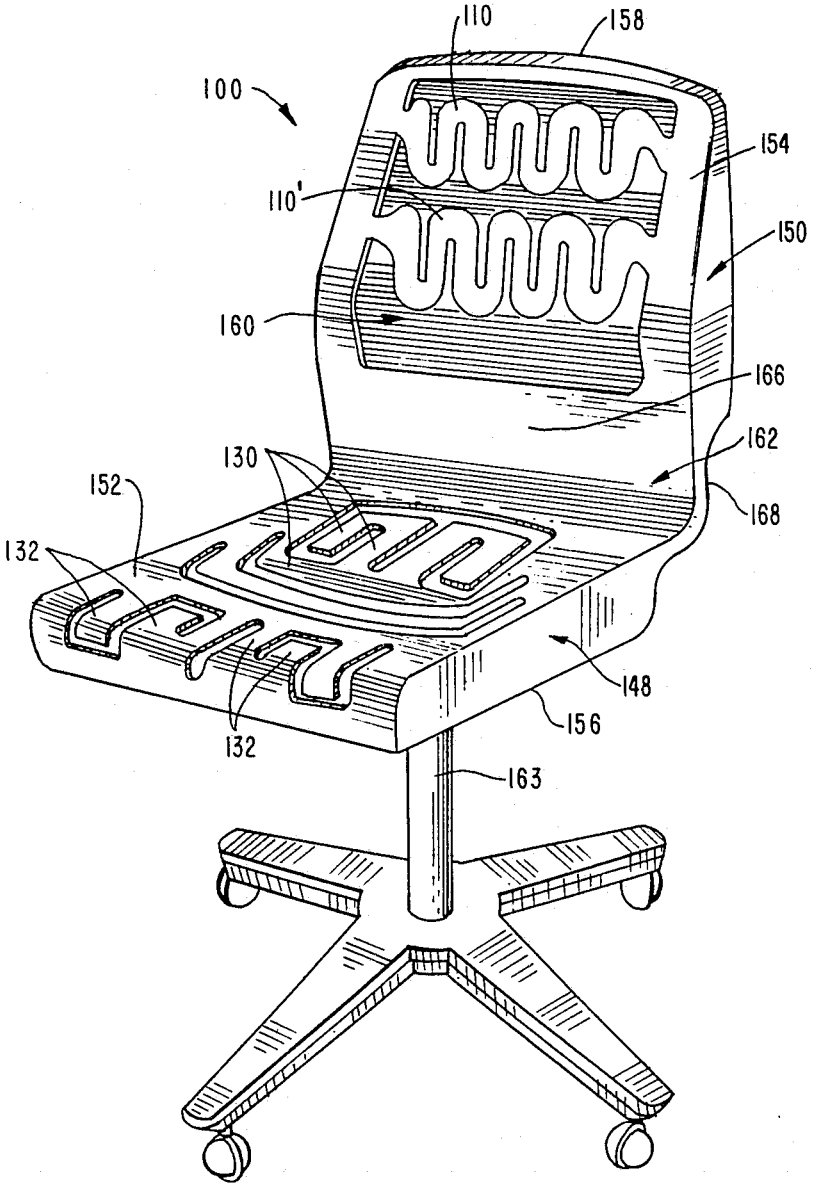
FIG. 17 is a perspective view of another embodiment of an ergonomic chair having the posterior and lumbar supporting portions integrally blow molded from a hollow shell and joined by a flexible, integrally formed, pinched connecting member.

Turning now to FIG. 17, there is shown another embodiment of the present invention, wherein the posterior and lumbar supporting shell portions 148, 150 are joined together by a connecting shell portion 162 having an inner shell member 166 and an outer shell member 168. The inner and outer shell members 166, 168 are pinched together to have a reduced cross-sectional area, so as to be flexible, thereby functioning in the manner of the J-shaped member 164, as described with reference to FIG. 16.

Figure 18:
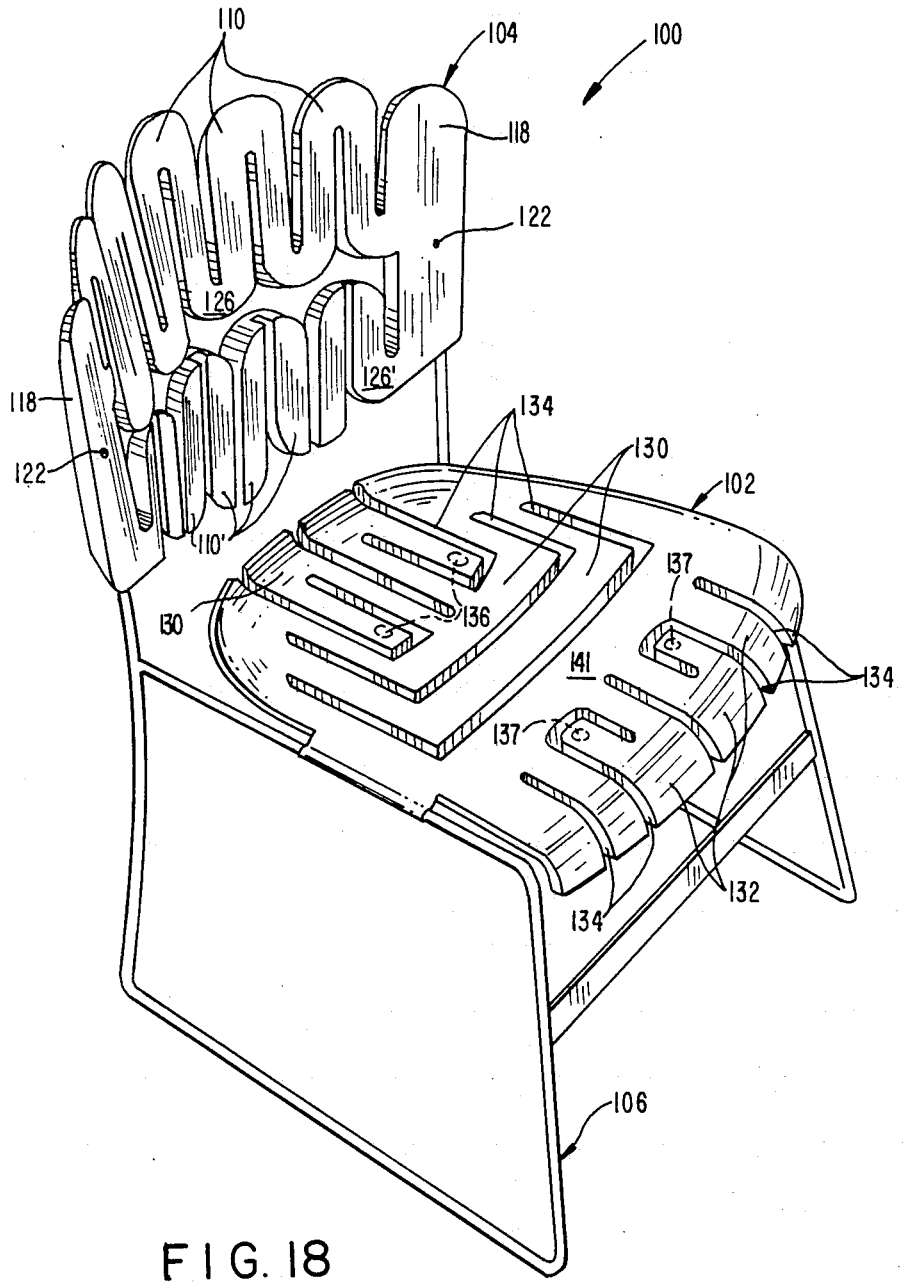
FIG. 18 is a perspective view of the preferred embodiment of an ergonomic chair wherein the lumbar and posterior supporting surfaces include non-planar and compound curved surfaces to achieve a three-dimensional, contoured front surface.

Finally, turning to FIG. 18, there is disclosed a perspective view of an ergonomic chair 100 constructed in accordance with the preferred embodiment of the present invention. The chair 100 includes an ergonomic lumbar supporting portion 104 constructed in accordance with the lumbar supporting portion, as shown and described with reference to FIGS. 4–6. In addition, the chair 100 includes a posterior supporting portion 102 constructed generally in accordance with the posterior supporting portions, as shown and described in FIGS. 7–11 and specifically in FIG. 12. The posterior and lumbar supporting portions 102, 104 include contoured body supporting surfaces 126, 126', 141 formed from compound curves, i.e., non-planar curved surfaces, to provide an effective ergonomic support. In this regard, the support members 110, 130 and flexible support members 132 individually and cooperatively provide flexible support for the lumbar and posterior regions of a person, which support members automatically conform to one's body for different sitting positions.

As in the previously described embodiments, the support members 110, 130 and flexible support members 132 can be constructed of different cross-sectional areas, or laminated with different materials having different flexibility and resiliency characteristics, or varying contoured supporting surfaces to achieve controlled flexibility and resiliency of the posterior and lumbar supporting portions 102, 104. Thus, it should be understood that the ergonomic chair 100, including the posterior and lumbar supporting portions 102, 104, is provided with a number of design elements which permit great latitude in flexibility, resiliency and ability to adjust and conform to the supported region of a person during different sitting positions without the need of mechanical elements. In addition, the posterior and lumbar supporting portions 102, 104 can be upholstered and cushioned in the same manner as described with reference to the chair illustrated in FIGS. 13 and 14.

There has thus far been described an ergonomic chair 100 which adjusts and conforms to body movement without mechanical components, which is inexpensive to manufacture from a variety of materials, which includes a posterior and lumbar supporting portion having non-planar, contoured supporting surfaces formed of compound curves, each of unitary construction, which employs patterned resilient cantilevers to achieve controlled support, which can be blow molded to provide an integral posterior and lumbar supporting portion, and whose flexibility and resiliency can be readily varied by design changes.

Although the invention herein has been described with reference to particular embodiments, it is to be understood that these embodiments are merely illustrative of the principles and application of the present invention. For example, the chair 100, specifically the posterior and lumbar supporting portions 102, 104 illustrated in FIG. 1 through FIG. 12, can be upholstered and cushioned in the same manner as described with reference to the chair illustrated in FIGS. 13 and 14. It is therefore to be understood that numerous modifications may be made in the illustrative embodiments and that other arrangements may be devised without departing from the spirit and scope of the present invention, as defined by the appended claims.

What is claimed is:

1. An ergonomic support comprising a posterior supporting portion, and a lumbar supporting portion, said lumbar supporting portion including a plurality of first support members joined together to individually and cooperatively provide flexible support for the lumbar region of a person, said posterior supporting portion including a plurality of second support members arranged to individually and cooperatively provide flexible support for the posterior portion of a person, said second support members formed by providing concentric C-shaped openings within said posterior supporting portion, each of said first support members having a portion separated from an adjacent one of said first support members by an elongated opening, a ratio of the width of said opening to the width of an adjacent one of said first support members being in the range of about 1:4 to 1:11, whereby said first support members conform to the lumbar region of a person for different body positions.

2. The ergonomic support of claim 1 wherein a pair of adjacent first support members are joined together at one common end and supported at their other common end by adjacent first support members to provide a cantilever.

3. An ergonomic support comprising a posterior supporting portion and a lumbar supporting portion, at least one of said supporting portions including a first shell having an inner member and an outer member, said inner member including a plurality of individual first support members formed from a portion thereof, said first support members being joined together to individually and cooperatively provide flexible support for a supported region of a person, whereby said first support members conform to said supported region upon flexing in response to different body positions.

4. An ergonomic support comprising a posterior supporting portion and a lumbar supporting portion, said lumbar supporting portion including a plurality of first support members joined together to individually and cooperatively provide flexible support for the lumbar region of a person, said first support members providing an interrupted lumbar supporting surface having individually contoured supporting portions extending outwardly varying distances from a common reference plane such that different contoured supporting portions conform to different portions of the lumbar region of a person for support thereof in response to different body positions.

5. An ergonomic support comprising a posterior supporting portion, a lumbar supporting portion, said lumbar supporting portion including a plurality of first support members joined together and arranged in an initial position to individually and cooperatively provide flexible support for the lumbar region of a person, support means for supporting said lumbar supporting portion adjacent to and spaced from said posterior supporting portion, and pivoting means for pivotally attaching said lumbar supporting portion at opposite side ends thereof to said support means for independent pivotal movement relative to said posterior supporting portion, whereby said first support members are individually displaceable from their said initial position upon pivoting of said lumbar supporting portion in response to different body positions so as to conform said lumbar supporting portion to the lumbar region of a person.

6. The ergonomic support of claim 1 wherein said first support members are arranged adjacent one another in a first row for supporting the lumbar region of a person.

7. The ergonomic support of claim 6 further including a pair of spaced-apart side frame members for attaching said lumbar supporting portion therebetween, said lumbar supporting portion attached at the ends of said first row to a respective one of said side frame members about a pivot point.

8. The ergonomic support of claim 6 wherein said lumbar supporting portion further includes a plurality of third support members arranged adjacent one another and joined together in a second row to individually and cooperatively provide flexible support for the lumbar region of a person.

9. The ergonomic support of claim 8 further including a pair of spaced-apart side frame members for attaching said first and second rows of said lumbar supporting portion therebetween, a pair of end joining members for joining the common ends of said first and second rows of said first and third support members together, said end joining members attached to a respective one of said frame members about a pivot point.

10. The ergonomic support of claim 8 wherein at least two adjacent first support members of said first row and at least two adjacent third support members of said second row have different cross-sectional areas to provide a varying degree of resiliency to said lumbar supporting portion.

11. The ergonomic support of claim 1 wherein at least two first support members have different cross-sectional areas to provide a varying degree of resiliency to said lumbar supporting portion.

12. The ergonomic support of claim 1 wherein said second support members comprise cantilevers, said cantilevers arranged for supporting the left and right ischial tuberosity of a person.

13. The ergonomic support of claim 1 wherein said posterior supporting portion includes a front portion having a plurality of flexible support members formed from a portion thereof by a plurality of openings therein.

14. The ergonomic support of claim 13 wherein said front portion including said flexible support members is curved downward.

15. An ergonomic support comprising a posterior supporting portion, and a lumbar supporting portion, said lumbar supporting portion including a plurality of first support members joined together to individually and cooperatively provide flexible support for the lumbar region of a person, said posterior supporting portion including a plurality of second support members arranged to individually and cooperatively provide flexible support for the posterior portion of a person, said second support members formed by providing concentric C-shaped openings within said posterior supporting portion, said first support members each having a rear surface and a lumbar supporting front surface, said front surface having portions extending outwardly varying distances from a common reference plane, whereby said first support members conform to the lumbar region of a person for different body positions.

16. The ergonomic support of claim 4 wherein said interrupted lumbar supporting surface comprises a compound curved surface.

17. The ergonomic support of claim 4 wherein a pair of adjacent first support members are joined together at one common end and supported at their other common end by adjacent first support members to provide a cantilever.

18. The ergonomic support of claim 4 wherein said first support members are arranged adjacent one another in a first row for supporting the lumbar region of a person.

19. The ergonomic support of claim 18 further including a pair of spaced-apart side frame members for attaching said lumbar supporting portion therebetween, said lumbar supporting portion attached at the ends of said first row to a respective one of said side frame members about a pivot point.

20. The ergonomic support of claim 18 wherein said lumbar supporting portion further includes a plurality of second support members arranged adjacent one another and joined together in a second row to individually and cooperatively provide flexible support for the lumbar region of a person.

21. The ergonomic support of claim 20 wherein at least two adjacent first support members of said first row and at least two adjacent second support members of said second row have different cross-sectional areas to provide a varying degree of resiliency to said lumbar supporting portion.

22. The ergonomic support of claim 17 wherein the cross-sectional area of selected cantilevers at said one common end is less than the cross-sectional area of adjacent first support members forming said cantilever.

23. The ergonomic support of claim 4 wherein at least two first support members have different cross-sectional areas to provide a varying degree of resiliency to said lumbar supporting portion.

24. The ergonomic support of claim 15 wherein said second support members comprise cantilevers, said cantilevers arranged for supporting the left and right ischial tuberosity of a person.

25. The ergonomic support of claim 4 wherein said posterior supporting portion includes a front portion having a plurality of flexible support members formed from a portion thereof by a plurality of openings therein.

26. The ergonomic support of claim 25 wherein said front portion including said flexible support members is curved downward.

27. An ergonomic support comprising a posterior supporting portion, a lumbar supporting portion, at least one of said supporting portions comprising a first shell having an inner member and an outer member, said inner member forming said supporting portion, and a plurality of first support members formed from a portion of said inner member of said first shell, said support members joined together to individually and cooperatively provide flexible support for a supported region of a person, whereby said support members conform to said supported region for different body positions, said posterior supporting portion including a plurality of second support members formed therefrom and constructed and arranged to individually and cooperatively provide flexible support for the posterior portion of a person, said second support members formed by providing concentric C-shaped openings within said posterior supporting portion.

28. The ergonomic support of claim 3 wherein said first shell comprises said lumbar supporting portion and said posterior supporting portion comprising a second shell having an inner member and an outer member, said inner member of said second shell forming said posterior supporting portion.

29. The ergonomic support of claim 3 wherein said first support members each have a rear surface and a lumbar supporting front surface, said front surface having portions extending outwardly varying distances from a common reference plane.

30. The ergonomic support of claim 3 wherein said lumbar supporting portion includes a plurality of individual second support members arranged adajcent one another and joined together to individually and cooperatively provide flexible support for the lumbar region of a person, said first and second support members arranged in respective first and second rows.

31. The ergonomic support of claim 30 wherein at least two adjacent first support members of said first row and at least two adjacent second support members of said second row have different cross-sectional areas to provide a varying degree of resiliency to said lumbar supporting portion.

32. The ergonomic support of claim 3 wherein at least two first support members have different cross-sectional areas to provide a varying degree of resiliency to said lumbar supporting portion.

33. The ergonomic support of claim 28 wherein said posterior supporting portion includes a plurality of second support members formed from a portion of said inner member of said second shell, said second support members constructed and arranged to individually and cooperatively provide flexible support for the posterior portion of a person.

34. The ergonomic support of claim 27 wherein said second support members comprise cantilevers, said cantilevers arranged for supporting the left and right ischial tuberosity of a person.

35. The ergonomic support of claim 3 wherein said posterior supporting portion includes a front portion having a plurality of flexible support members formed from a portion thereof by a plurality of openings therein.

36. The ergonomic support of claim 35 wherein said front portion including said flexible support members is curved downward.

37. The ergonomic support of claim 3 further including resilient material provided within said first shell.

38. The ergonomic support of claim 28 further including a third shell joining said first shell to said second shell portion.

39. The ergonomic support of claim 38 wherein said first shell, said second shell portion and said third shell are integrally formed.

40. The ergonomic support of claim 38 wherein said third shell has a cross-sectional area such that said third shell is flexible.

41. The ergonomic support of claim 3 further including a connecting member rigidly attached to said posterior supporting portion and pivotally attached to said first shell.

42. An ergonomic support comprising a posterior supporting portion, a lumbar supporting portion, and attaching means for attaching said lumbar supporting portion adjacent to said posterior supporting portion, said lumbar supporting portion including a plurality of first support members joined together to individually and cooperatively provide flexible suport for the lumbar region of a person, said posterior supporting portion including a plurality of second support members arranged to individually and cooperatively provide flexible support for the posterior portion of person, said second support members formed by providing a plurality of concentric C-shaped openings within said posterior portion, said lumbar supporting portion pivotally attached at opposite ends thereof to said attaching means, whereby said first support members conform to the lumbar region of a person for different body positions.

43. The ergonomic support of claim 5 wherein a pair of adjacent first support members are joined together at one common end and supported at their other common end by adjacent first support members to provide a cantilever.

44. The ergonomic support of claim 5 wherein said first support members are arranged adjacent one another in a first row for supporting the lumbar region of a person.

45. The ergonomic support of claim 44 wherein said lumbar supporting portion further includes a plurality of second support members arranged adjacent one another and joined together in a second row to individually and cooperatively provide flexible support for the lumbar region of a person.

46. The ergonomic support of claim 45 wherein at least two adjacent first support members of said first row and at least two adjacent second support members of said second row have different cross-sectional areas to provide a varying degree of resiliency to said lumbar supporting portion.

47. The ergonomic support of claim 5 wherein at least two first support members have different cross-sectional areas to provide a varying degree of resiliency to said lumbar supporting portion.

48. The ergonomic support of claim 5 wherein said posterior supporting portion includes a front portion having a plurality of flexible support members formed from a portion thereof by a plurality of openings therein.

49. The ergonomic support of claim 5 wherein at least two adjacent first support members are constructed of materials having different flexibility characteristics.

50. An ergonomic support comprising a lumbar supporting portion and a posterior supporting portion, said lumbar supporting portion including a first non-planar member having a contoured lumbar supporting surface, and a plurality of first support members forming at least a portion of said non-planar member, said first support members joined together to individually and cooperatively provide flexible support for a supported region of a person, whereby said first support members conform to said supported region for different body positions, said posterior supporting portion including a plurality of second support members arranged to individually and cooperatively provide flexible support for the posterior portion of a person, said second support members formed by providing concentric C-shaped openings within said posterior support portion.

51. The ergonomic support of claim 50 wherein said supporting surface is shaped as a non-planar, contoured surface.

52. The ergonomic support of claim 50 wherein said supporting surface is shaped as a compound curved surface.

53. The ergonomic support of claim 50 wherein said supporting surface is shaped as a three-dimensional curved surface.

54. The ergonomic support of claim 50 wherein said supporting surface has portions thereof extending outwardly varying distances from a common reference plane.

55. The ergonomic support of claim 52 further including a pair of spaced-apart side frame members for attaching said lumbar supporting portion therebetween, said lumbar supporting portion attached to a respective one of said side frame members about a pivot point.

56. The ergonomic support of claim 50 wherein said lumbar supporting portion further includes a plurality of second support members arranged adjacent one another and joined together to individually and cooperatively provide flexible support for the lumbar region of a person, said first and second support members arranged in respective first and second rows.

57. The ergonomic support of claim 56 wherein at least two adjacent first support members of said first row and at least two adjacent second support members of said second row have different cross-sectional areas to provide a varying degree of resiliency to said lumbar supporting portion.

58. The ergonomic support of claim 50 wherein the cross-sectional area of selected first support members at one common end is less than the cross-sectional area of adjacent first support members.

59. The ergonomic support of claim 50 wherein at least two first support members have different cross-sectional areas to provide a varying degree of resiliency to said lumbar supporting portion.

60. The ergonomic support of claim 50 wherein at least two first support members have differently shaped contoured lumbar supporting surfaces.

61. The ergonomic support of claim 50 wherein another of said posterior supporting portion includes a second non-planar member having a contoured posterior supporting surface, and a plurality of second support members formed from a portion of said second non-planar member, each of said supporting surfaces shaped as compound curved surfaces to provide ergonomic support for the lumbar and posterior regions of a person.

62. The ergonomic support of claim 13, wherein at least one of said openings is arranged lateral to said posterior supporting portion.

63. The ergonomic support of claim 25, wherein at least one of said openings is arranged lateral to said posterior supporting portion.

64. The ergonomic support of claim 35, wherein at least one of said openings is arranged lateral to said posterior supporting portion.

65. The ergonomic support of claim 48, wherein at least one of said openings is arranged lateral to said posterior supporting portion.

* * * * *

UNITED STATES PATENT AND TRADEMARK OFFICE

CERTIFICATE OF CORRECTION

PATENT NO. : 4,660,887

DATED : April 28, 1987

INVENTOR(S) : P.S. Fleming, et al.

It is certified that error appears in the above-identified patent and that said Letters Patent is hereby corrected as shown below:

Column 3, line 29, change "jointed" to --joined--.

Column 4, line 19, change "anther" to --another--.

Column 5, line 48, change "transvers" to --transverse--.

Column 7, lines 16-17, change "cros-ssectional" to --cross-sectional--.

Column 13, line 45, change "adajcent" to --adjacent--.

Column 14, line 15, delete "portion";

line 17, delete "portion";

line 32, change "suport" to --support--.

Column 15, line 38, change "52" to --50--.

Signed and Sealed this

Third Day of November, 1987

*Attest:*

DONALD J. QUIGG

*Attesting Officer*

*Commissioner of Patents and Trademarks*